US005943713A

United States Patent [19]

Paterson et al.

[11] Patent Number: 5,943,713

[45] Date of Patent: Aug. 31, 1999

[54] SENSOR ASSEMBLY HAVING FLEXIBLY MOUNTED SENSOR AND ADJUSTABLE MOUNTING MEANS

[75] Inventors: Graham H. Paterson, Wilmington; Willard A. Denham, Greenville, both of Del.

[73] Assignee: Speakman Company, Wilmington, Del.

[21] Appl. No.: 09/019,861

[22] Filed: Feb. 6, 1998

[51] Int. Cl.[6] ..... E03C 1/05

[52] U.S. Cl. ..... 4/623

[58] Field of Search ..... 4/623

[56] References Cited

U.S. PATENT DOCUMENTS

| | | |
|---|---|---|
| 3,724,001 | 4/1973 | Ichimori et al. . |
| 4,606,085 | 8/1986 | Davies . |
| 4,739,801 | 4/1988 | Kimura et al. . |
| 4,942,631 | 7/1990 | Rosa . |
| 5,046,764 | 9/1991 | Kimura et al. . |
| 5,060,323 | 10/1991 | Shaw . |
| 5,069,486 | 12/1991 | Kimura et al. . |
| 5,170,944 | 12/1992 | Shirai . |
| 5,197,767 | 3/1993 | Kimura et al. . |
| 5,215,338 | 6/1993 | Kimura et al. . |
| 5,412,816 | 5/1995 | Paterson et al. . |
| 5,449,206 | 9/1995 | Lockwood . |
| 5,620,352 | 4/1997 | Tzong . |

*Primary Examiner*—Charles E. Phillips
*Attorney, Agent, or Firm*—Connolly & Hutz

[57] ABSTRACT

A sensor assembly for use with a sink having a faucet hydraulically connected to an electrically operated on/off mechanism for controlling the flow of water from the faucet into the sink. The sensor assembly includes a short focus optical sensor mounted adjacent the sink which directs an infrared ray toward a user's legs for detecting the presence and absence of a user in the immediate vicinity of the sink. The senor assembly also includes an adjustable pipe clamp for connecting the sensor assembly to the drain tube of the sink, and a ball-and-socket flexible connector for interconnecting the optical sensor to the adjustable clamp. The optical sensor is electrically connected to the on/off mechanism, via a conduit provided in the ball-and-socket flexible connector, so as to turn on the faucet when the presence of the user is detected and turn off the faucet when the absence of a user is detected.

15 Claims, 2 Drawing Sheets

SENSOR ASSEMBLY HAVING FLEXIBLY MOUNTED SENSOR AND ADJUSTABLE MOUNTING MEANS

BACKGROUND OF THE INVENTION

A. Field of the Invention

The present invention relates generally to a sensor assembly for automatic sinks, and, more particularly, to a sensor assembly having a flexibly mounted sensing means and an adjustable mounting means. Such a sensor assembly may be used with any type of automatic sink or in other applications requiring an automatically controlled supply of water, chemical, etc. Preferably, however, such a sensor assembly is used with surgical scrub sinks.

B. Description of the Related Art

Automatic sinks are used in order to permit a person to wash his or her hands without the need to turn on or off water supply faucets. Without such automatic sinks, a water supply may be left running or conversely require human skin contact for operation. The latter is a particular problem in surgical sinks where it is essential that the surgeon not touch any object which might be unsterile. Public restrooms are also another location where dangerous bacterial and fungal deposits on water supply faucets pose a potential health risk. This has lead to various approaches for controlling the on and off operation of faucets, particularly in surgical scrub sinks, which do not require the user to physically touch any control knob for manipulating the faucet.

Among the approaches that have been attempted is the utilization of an infrared sensor above or in the sink itself for detecting the user's hands in the vicinity of the faucet such as disclosed in Rosa, U.S. Pat. No. 4,942,631. A disadvantage with this approach, however, is that the faucet turns off when the user's hands are moved away from the immediate vicinity of the faucet, although the washing operation has not been completed. It is then necessary to turn the faucet on again when the presence of the user's hands is detected. This results in an intermittent on-and-off action of the faucet.

Attempts to avoid the above problems have resulted in variations such as changing the spread or focal length of the sensor so to detect the user's hands when they are not in the immediate vicinity of the faucet. A disadvantage with this approach, however, is the detection of other objects in the sensor beam causing false signals which result in the faucet being turned on even though the user is not present.

Another approach is illustrated in Paterson et al., U.S. Pat. No. 5,412,816, assigned to the assignee of the present invention, where a short focus sensor is fixedly mounted to the drain pipe of a sink tub and a wall at the height of the user's legs for detecting the presence or absence of the user in the vicinity of the tub. The sensor is operatively connected to a water supply on/off mechanism so as to turn on the faucet when the presence of the user is detected and to turn off the faucet when the user is absent. Such an arrangement has solved the disadvantages of the various approaches noted above. However, the arrangement does not permit the sensor to be custom fit to a variety of sinks or to be adjustably positioned due to its fixed mounting configuration.

SUMMARY OF THE INVENTION

An object of this invention is to provide an automatically operated sink which overcomes the above disadvantages.

A further object of this invention is to provide such a sink which maintains operation of the faucet as long as the user is in the immediate vicinity of the tub, without requiring the user's hands to be physically located at the faucet.

A still further object is to provide a sensor assembly which can be fitted directly to various types of sinks or adjacent various sinks, and which can be positioned by the user to accommodate his or her particular needs.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a sensor assembly for use with a sink mounted above a floor, wherein the sink includes a drain hole and a drain tube connected to the drain hole, a faucet mounted over and disposed toward the sink, and an electrically operated on/off mechanism for controlling the flow of water from the faucet into the sink. The sensor assembly comprises an optical sensor; and a ball-and-socket flexible connector interconnecting the optical sensor to the on/off mechanism and providing a conduit through which the optical sensor is electrically connected to the on/off mechanism for controlling the flow of water from the faucet.

Further in accordance with the purpose of the invention, the present invention comprises a sensor assembly for use with an electrically operated on/off mechanism controlling a fluid flow. The sensor assembly comprises an optical sensor; and a ball-and-socket flexible connector interconnecting the optical sensor to the on/off mechanism and providing a conduit through which the optical sensor is electrically connected to the on/off mechanism for controlling the on/off mechanism and fluid flow.

Still further in accordance with the objects, the present invention comprises an adjustable connecting means for connecting a drain tube of a sink to a sensor assembly for use with an electrically operated on/off mechanism controlling a fluid flow to the sink, wherein the sensor assembly comprises an optical sensor and a ball-and-socket connector interconnecting the optical sensor to the on/off mechanism and providing a conduit through which the optical sensor is electrically connected to the on/off mechanism for controlling the on/off mechanism and fluid flow. The adjustable connecting means comprises a mount bracket, and a clamp having a semicircular surface compressing the drain tube between itself and the mount bracket so to support the sensor assembly.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate one embodiment of the invention and together with the description, serve to explain the principles of the invention. In the drawings.

DETAILED DESCRIPTION OF THE PREFERRED EMBODIMENTS

Reference will now be made in detail to the present preferred embodiment of the invention, an example of which is illustrated in the accompanying drawings. Wherever possible, the same reference numbers will be used throughout the drawings to refer to the same or like parts.

The present invention involves improvements over sinks utilizing automatic control means for turning a faucet on and off. The concepts of the invention may be practiced with various types of known sinks wherein the invention is incorporated therein by providing a sensor mounted at a location which would generally correspond to the legs of a user, and more particularly the knee area, at the immediate vicinity of the sink tub. Preferably, the sensor is of short focus with a focal distance of about two to six inches, so as to avoid false signals which would otherwise be caused by detecting objects other than the user of the sink. The invention is based upon the recognition that when the user of the sink is washing his or her hands, he or she will stand immediately juxtaposed the sink tub during the hand washing operation and will remain in that position until the hand washing operation is completed, although during the hand washing operation there might be periods of time when the hands are not in the immediate vicinity of the faucet. Thus, the present invention does not rely upon detection of the hands near the faucet, but rather on the detection of the legs near the sink tub.

Figure 1:
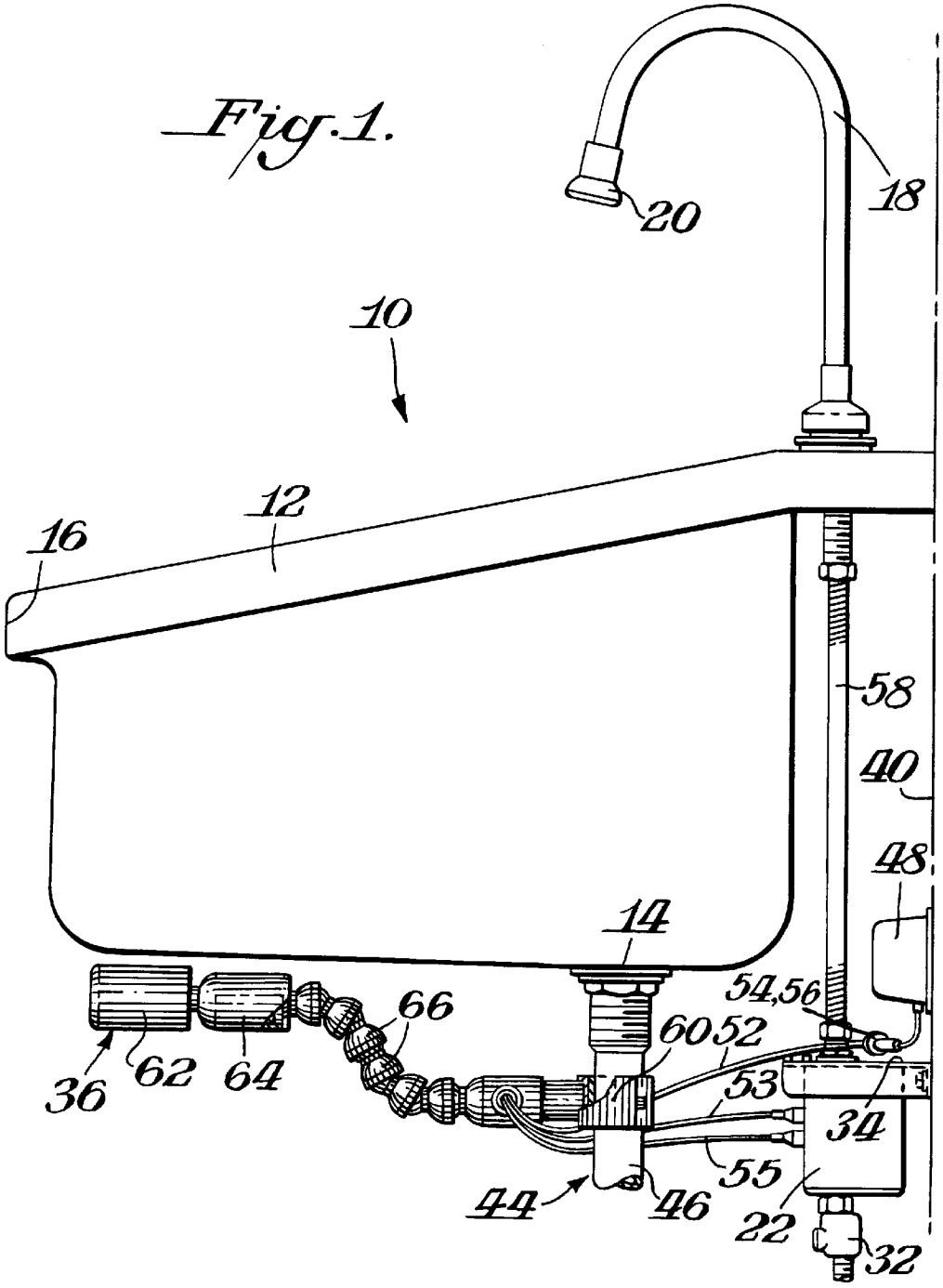
FIG. 1 is a side elevational view of a sink having a sensor attached to a flexible connector and an adjustable pipe clamp in accordance with this invention.

In FIG. 1, a sink 10 is shown which includes a tub 12 of any suitable known description. Tub 12 typically includes a drain hole 14 at its lower portion and includes a front edge 16. A faucet 18 is mounted at the top of tub 12. Faucet 18 terminates in a nozzle 20 which is disposed over and toward the open body of tub 12. A drain tube 44 leading from drain hole 14 is mounted to tub 12 and has a tail piece 46 extending downward.

Figure 4:
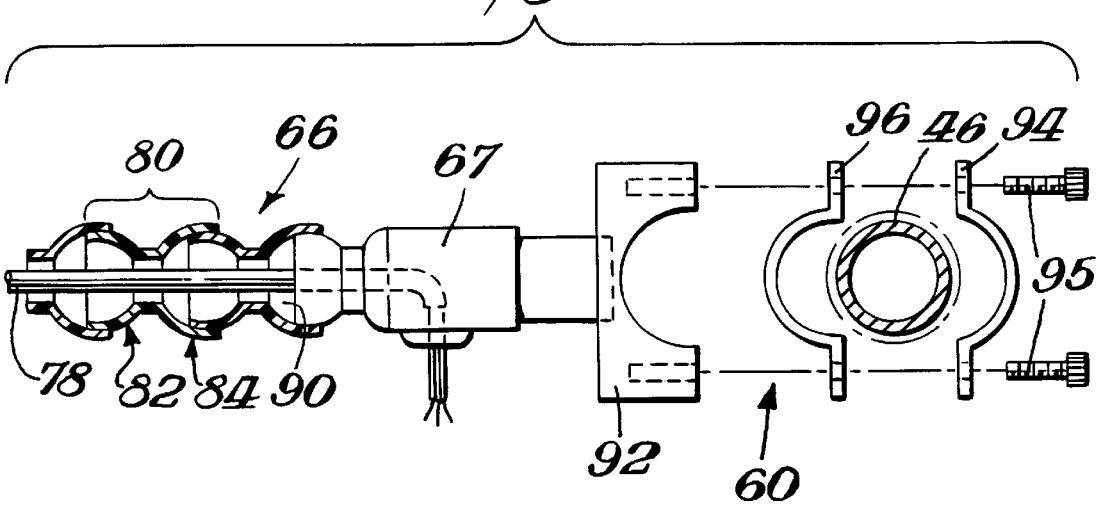
FIG. 4 is an exploded section view of the flexible connector and adjustable pipe clamp shown in FIGS. 1 and 2.

Faucet 18 is electrically operated by an on/off mechanism 22, as known in the art. Such on/off mechanism 22 may include, for example, a solenoid controlled electronic mixing valve which, as shown in FIG. 4 of Paterson et al. (U.S. Pat. No. 5,412,816), herein incorporated by reference, includes a solenoid 26 mounted in a housing. A sensor module cable is also provided in the housing as well as other known components such as an in-line strainer 32. The housing or enclosure for the on/off mechanism 22 is mounted to a support arm 34, as shown in FIG. 1. Support arm 34 fixedly mounts to any suitable support, such as a wall 40. Tub 12 may also be mounted on wall 40 or supported with legs (not shown). On/off mechanism 22 is hydraulically connected by a reinforced hose 58 to faucet 18.

On/off mechanism 22 further includes a power supply 48 mounted at any suitable location, such as to wall 40. The wiring 50 for power supply 48 is electrically connected to the wiring 52 from a sensor assembly 36 by means of mating coupling members 54, 56. Power supply 48 may be of any suitable known construction such as a six- or twelve-volt battery or a step-down transformer converting from 110 volts to six or twelve volts.

As further shown in FIG. 1, sensor assembly 36 comprises an adjustable pipe clamp 60 for securing sensor assembly 36 to tail piece 46, a sensor housing 62 connected to a flexible sanitary sheaf 64, and a ball-and-socket flexible connector 66 interconnecting pipe clamp 60 and sanitary sheaf 64.

Figure 2:
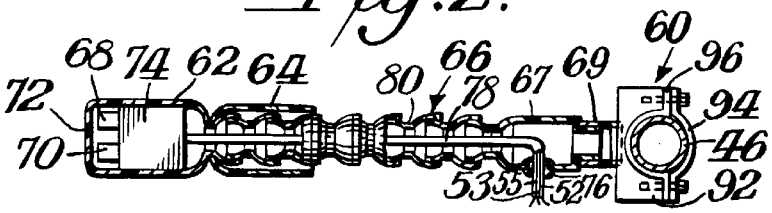
FIG. 2 is a top plan view partially in section of the sensor, flexible connector, and adjustable pipe clamp shown in FIG. 1.

As best shown by FIG. 2, within sensor housing 62 there is a sensor emitter 68 for emitting an infrared ray (rays beyond the red end of the visible light spectrum) in a known manner, a sensor receiver 70 for receiving infrared rays reflected from a user, and a computer board 74 electrically connected to sensor emitter 68 and sensor receiver 70. Computer board 74 provides a signal to sensor emitter 68 instructing emitter 68 to generate the infrared ray. Computer board 74 also receives a signal from sensor receiver 70 indicating the presence of the user or receives no signal from receiver 70 indicating the absence of the user. A cable 78, having a plurality of wires, electrically connects computer board 74 to on/off mechanism 22.

Cable 78 comprises a power supply wire 52 for supplying electrical power to computer board 74 and sensor assembly 36; an "on" wire 53 for energizing on/off mechanism 22 to an open position (turning on faucet 18) when computer board 74 detects the presence of the user; and an "off" wire 55 for energizing on/off mechanism 22 to a closed position (turning off faucet 18) when computer board 74 fails to detect the user. Cable 78 is protected from over-bending by sanitary sheaf 64 and ball-and-socket flexible connector 66.

Ball-and-socket flexible connector 66 comprises a plurality of interconnected units 80, as best shown in FIG. 4. Each unit 80 includes a ball portion 82 and a socket portion 84, wherein the ball portion of one unit is accommodated, preferably snap-fit, within the socket portion of an adjacent unit. Units 80 are designed so that there is a wide degree of flexibility and motion of the ball and socket portions 82, 84 relative to each other. Therefore, flexible connector 66 has unlimited relative rotation and almost unlimited flexibility in positioning sensor assembly 36 relative to potential users. However, flexible connector 66 also prevents displacement of cable 78 running through a passageway 90 in connector 66, so that cable 78 is not damaged.

Cable 78 traverses the length of and exits connector 66 through a grommet 76 provided in a hole 77 in a connector end unit 67. Grommet 76 limits strain in cable 78, preventing damage thereto. Connector end unit 67 preferably includes a threaded portion 69 for connecting to pipe clamp 60.

Figure 3:
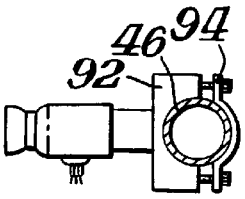
FIG. 3 is a top plan view of the adjustable pipe clamp shown in FIGS. 1 and 2, attached to a larger sink drain pipe.

Adjustable pipe clamp 60 comprises a mount bracket 92 for connecting to threaded portion 69 of end unit 67, and further comprises a clamp 94. Mount bracket 92 mates with clamp 94, preferably via screws 95, so to hold tail piece 46 of drain pipe 44 therebetween. Depending upon the diameter of tail piece 46, pipe clamp 60 can further comprise an adaptor sleeve 96 for fitting pipe clamp 60 onto drain pipes having smaller diameters, as shown in FIGS. 2 and 4. Alternatively, as shown in FIG. 3, pipe clamp 60 can comprise only mount bracket 92 and clamp 94 for fitting pipe clamp 60 onto drain pipes having larger diameters. The inclusion of adapter sleeve 96 as part of the adjustable clamp allows immediate, on-site adaptation of the clamp for use on the two principle drain tube sizes used in the United States, namely 1.25 inch (outer diameter) and 1.5 inch (outer diameter) pipe.

Furthermore, pipe clamp 60 can comprise various configurations if sensor assembly 36 is to be mounted to places other than a drain pipe. For example, pipe clamp 60 may comprise a vise-like configuration for mounting to flat surfaces and may include rubber-type surfaces for improved frictional clamping.

As a result, the position of sensor assembly 36 can be adjusted to its intended location with respect to front edge 16 of tub 12. This assures that the sensor assembly 36 will detect the presence or absence of the user standing in front of or juxtaposed to front edge 16 of tub 12, no matter how long or short tub 12 is. Accordingly, it is possible to use a short focus sensor having an effective focal distance of about two to six inches, and still reliably sense the presence or absence of a user standing at sink 10. The elevation of sensor 36 above the floor would be selected to correspond to the elevation of the user's legs, such as the knee area. Other locations of the user's legs could also be used as the detecting target. Thus, sensor assembly 36 could be elevated above the floor at any suitable distance, such as for example, six inches to thirty inches.

Preferably, sensor assembly 36 comprises a short-focus sensor, such as a commercially available Kodak® R27 Grey Card photosensor. The focal distance of the photosensor is fixed by moving the grey card toward the sensor until the grey side of the card reflects the infrared rays back to the sensor receiver. It has been found that various skin tones, as well as light-colored clothing fall into the same range of activation as the Kodak® R27 Grey Card photosensor. As noted above, sensor assembly 36 is set to activate the Kodak® R27 Grey Card photosensor at a distance of two to six inches.

The invention would thus be practiced by suitably positioning sensor housing 62 at the desired location, generally at the front edge 16 of tub 12. Sensor emitter 68 would project an infrared ray so that the presence or absence of an object in the range of the infrared ray is detected. Because sensor assembly 36 preferably operates with a short focus, the presence of an object would be detected only when the object is in the immediate vicinity of front edge 16 at the elevation of sensor module 36. Thus, under ordinary conditions no object would be detected. The absence of an object permits the on/off mechanism 22 to remain in its off condition so that no water flows from spray nozzle 20.

When, however, a user steps to front edge 16 of sink 10 to perform a hand washing operation, sensor assembly 36 would detect the presence of an object, namely the user's legs. Sensor assembly 36 would transmit a signal to on/off mechanism 22, via computer board 74 and "on" wire 53, to actuate solenoid 26 and permit water to flow through tube 58 into faucet 18 and eventually from spray nozzle 20. The water would continue to flow as long as the user remained at the front of tub 12. There would thus be no interruption in the flow even under periods where the user's hands are not in the immediate vicinity of faucet 18. Upon completion of the hand washing operation, the user would step away from tub 12, sensor assembly 36 would detect the absence of the user, and a corresponding signal would be sent to solenoid 26, via computer board 74 and "off" wire 55, terminating water flow through faucet 18.

As shown in FIG. 4 of Paterson et al. (U.S. Pat. No. 5,412,816), an optional manual override valve (reference numeral 70 in the '816 patent) may also be provided to facilitate continued flow of water should there be an interruption in power to the solenoid 26. This manual override valve is linked to a backup battery power pack to maintain actuation of the solenoid, and resultant flow through faucet 18, in case of a power failure or equipment electronic failure. Preferably, the manual override valve comprises a ceramic valve type know in the art.

The invention thus provides automatic control of water flow during a hand washing operation so that the user's arms and hands are freely moveable while water flow is continuous from nozzle 20. Flow is terminated automatically upon completion of the hand washing operation and when the user is no longer present at sink 10. The invention also permits automatic control of water flow with a sensor assembly that can be customized to fit in various sinks and be positioned for optimum performance. Customization is achieved since, as noted above, ball-and-socket flexible connector 66 permits almost unlimited flexibility in positioning sensor assembly 36 relative to potential users, and adjustable pipe clamp 60 allows sensor assembly 36 to be mounted on a variety of drain tubes.

It will be apparent to those skilled in the art that various modifications and variations can be made in the sensor assembly of the present invention and in construction of this sensor assembly without departing from the scope or spirit of the invention. As an example, the sensor assembly of the present invention can be used in other applications requiring control of an on/off mechanism dependent upon the presence of a user, such as in surgical scrub sinks and public restroom sinks. As other examples, the sensor assembly can be used with eye wash stations, drinking fountains, dental wash stations, hairdressing salons, and food industry kitchens.

Furthermore, the present invention may be used with a sink mounted within a cabinet having doors. In such an application, a hole would be drilled in the front top rail of the cabinet to allow the sensor assembly to protrude there through, and the sensor assembly would be mounted to a wall of the cabinet.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A sensor assembly for use with a sink mounted above a floor, wherein the sink includes a drain hole and a drain tube connected to the drain hole, a faucet mounted over and disposed toward the sink, and an electrically operated on/off mechanism for controlling the flow of water from the faucet into the sink, the sensor assembly comprising:

an optical sensor;

a ball-and-socket flexible connector interconnecting the optical sensor to the on/off mechanism and providing a conduit through which the optical sensor is electrically connected to the on/off mechanism for controlling the flow of water from the faucet, wherein the ball-and-socket flexible connector permits the optical sensor to be positioned at various locations in horizontal and vertical planes located below the sink; and an adjustable connecting means for connecting the ball-and-socket flexible connector to the drain tube of the sink.

2. A sensor assembly as recited in claim 1, wherein the ball-and-socket flexible connector comprises a plurality of interconnected units, each unit including:

a ball portion; and a socket portion, wherein a ball portion of one unit is accommodated within a socket portion of an adjacent unit.

3. A sensor assembly as recited in claim 1, wherein the optical sensor comprises:

an emitter for emitting an infrared ray;

a receiver for receiving the infrared ray reflected from a user of the sink; and a computer board electrically connected to the emitter and receiver for determining when to send a signal indicating one of the presence or absence of the user so to turn on and off the flow of water.

4. A sensor assembly as recited in claim 1, wherein the adjustable connecting means comprises:

a mount bracket; and a clamp having a semicircular surface compressing the drain tube between itself and the mount bracket so to support the sensor assembly.

5. A sensor assembly as recited in claim 4, wherein the adjustable connecting means further comprises an adaptor sleeve fitted between the mount bracket and the drain tube.

6. A sensor assembly as recited in claim 5, wherein a portion of the adapter sleeve has a semicircular surface with a radius smaller than that of the clamp.

7. A sensor assembly for use with an electrically operated on/off mechanism controlling a fluid flow, the sensor assembly comprising:

an optical sensor;

a ball-and-socket flexible connector interconnecting the optical sensor to the on/off mechanism and providing a conduit through which the optical sensor is electrically connected to the on/off mechanism for controlling the on/off mechanism and fluid flow the ball-and-socket flexible connector permits the optical sensor to be positioned at various locations in horizontal and vertical planes located around the on/off mechanism; and an adjustable connecting means for connecting the ball-and-socket flexible connector to a drain tube adjacent the on/off mechanism.

8. A sensor assembly as recited in claim 7, wherein the optical sensor comprises:

an emitter for emitting an infrared ray;

a receiver for receiving the infrared ray reflected from a user of the on/off mechanism; and a computer board electrically connected to the emitter and receiver for determining when to send a signal indicating one of the presence or absence of the user adjacent the on/off mechanism.

9. A sensor assembly as recited in claim 7, wherein the adjustable connecting means comprises:

a mount bracket; and a clamp having a semicircular surface compressing the drain tube between itself and the mount bracket so to support the sensor assembly.

10. A sensor assembly as recited in claim 9, wherein the adjustable connecting means further comprises an adaptor sleeve fitted between the mount bracket and the drain tube.

11. A sensor assembly as recited in claim 10, wherein a portion of the adapter sleeve has a semicircular surface with a radius smaller than that of the clamp.

12. A sensor assembly as recited in claim 7, wherein the ball-and-socket flexible connector comprises a plurality of interconnected units, each unit including:

a ball portion; and a socket portion, wherein a ball portion of one unit is accommodated within a socket portion of an adjacent unit.

13. An adjustable connecting means for connecting a drain tube of a sink to a sensor assembly for use with an electrically operated on/off mechanism controlling a fluid flow to the sink, wherein the sensor assembly comprises an optical sensor and a ball-and-socket connector interconnecting the optical sensor to the on/off mechanism and the adjustable connecting means, the ball-and-socket flexible connector providing a conduit through which the optical sensor is electrically connected to the on/off mechanism for controlling the on/off mechanism and fluid flow and permitting the optical sensor to be positioned at various locations in horizontal and vertical planes located below the sink, the adjustable connecting means comprising:

a mount bracket; and a clamp having a semicircular surface compressing the drain tube between itself and the mount bracket so to support the sensor assembly.

14. An adjustable connecting means as recited in claim 13, further comprising an adaptor sleeve fitted between the mount bracket and the drain tube.

15. An adjustable connecting means as recited in claim 14, wherein a portion of the adapter sleeve has a semicircular surface with a radius smaller than that of the clamp.

* * * * *